US005097691A

United States Patent [19]

Slabowski et al.

[11] Patent Number: 5,097,691

[45] Date of Patent: Mar. 24, 1992

[54] ADJUSTABLE LEVELER

[75] Inventors: Jan Slabowski; Lawrence Richards, both of Schiller Park; Esteban Lopez, Chicago, all of Ill.

[73] Assignee: Braner, Inc., Schiller Park, Ill.

[21] Appl. No.: 646,427

[22] Filed: Jan. 28, 1991

[51] Int. Cl.[5] ..... B21D 1/02

[52] U.S. Cl. ..... 72/165; 72/163

[58] Field of Search ..... 72/164, 165, 161, 160, 72/163

[56] References Cited

U.S. PATENT DOCUMENTS

| | | | |
|---|---|---|---|
| 3,588,993 | 6/1971 | Turner | 198/394 |
| 3,631,960 | 1/1972 | Spuhl | 198/394 |
| 3,701,274 | 10/1972 | Roesch | 72/165 |
| 3,752,311 | 8/1973 | Kobusch et al. | 198/388 |
| 4,269,300 | 5/1981 | Spuhl | 198/394 |
| 4,380,921 | 4/1983 | Matsui | 72/160 |
| 4,633,697 | 1/1987 | Blough | 72/164 |

FOREIGN PATENT DOCUMENTS

| | | | |
|---|---|---|---|
| 11727 | 1/1982 | Japan | 72/165 |
| 38721 | 2/1987 | Japan | 72/160 |
| 633637 | 11/1978 | U.S.S.R. | 72/164 |

*Primary Examiner*—Daniel C. Crane

*Attorney, Agent, or Firm*—Thomas J. Dodd

[57] ABSTRACT

A leveling machine for slit steel which removes bends and bumps in the steel prior to recoiling. The leveler includes top and bottom sets of rollers of varying sizes to accommodate varying gauges of steel. The top of rollers is attached to a frame which pivots relative to the bottom frame to ensure proper roller orientation.

5 Claims, 5 Drawing Sheets

ADJUSTABLE LEVELER

FIELD OF THE INVENTION

This invention relates to leveling of slit steel and will have application to a leveler which includes adjustable frames to accommodate varying gauges of steel.

BACKGROUND OF THE INVENTION

Leveling of slit metal, such as steel is a recognized concept which is useful in removing bends, bumps, burrs and other flaws in the steel strip prior to recoiling. Leveling can also serve to even out differences in thickness of the steel along the strip. The basic concept of leveling can be seen in U.S. Pat. No. 4,614,101.

One basic flaw in current levelers of this sort is the inability of the machine to compensate for large variances in steel thickness, or gauge. Currently, levelers include only a single size of leveling roller which has a limited gauge capacity. To accommodate a large number of gauges of steel, several machines were required, or the leveling rollers had to be replaced. Neither alternative is acceptable from a downtime or cost standpoint.

SUMMARY OF THE INVENTION

The leveler of this invention includes first and second subframes which house rotatable leveling rollers of varying sizes to allow the leveler to accommodate a wide range of steel gauges. The upper subframe is pivotable with respect to the lower subframe to ensure proper alignment of the leveling rollers, while the lower subframe is slidable to ensure the proper gap between the rollers selected for the leveling operation.

Accordingly, it is an object of this invention to provide for an improved leveler for slit metal.

Another object is to provide for a leveler which can level a wide range of metal gauges.

Another object is to provide for a leveler which is easily and accurately adjusted.

Other objects will become apparent upon a reading of the following description.

BRIEF DESCRIPTION OF THE DRAWINGS

A preferred embodiment of the invention has been depicted for illustrative purposes wherein.

DESCRIPTION OF THE PREFERRED EMBODIMENT

Figure 1:
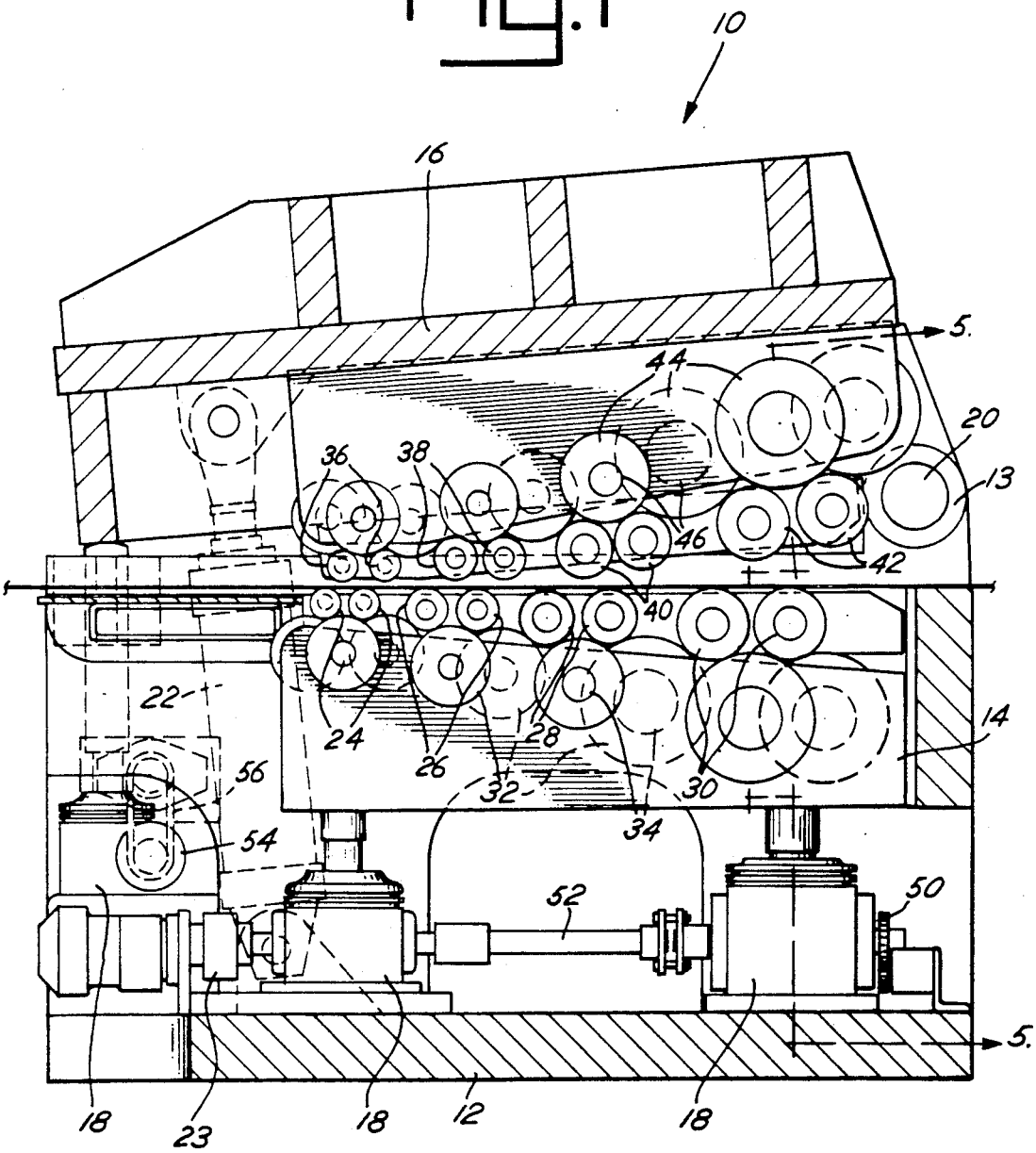
FIG. 1 is a vertical sectional view of the leveler in a first working position.

The preferred embodiment herein described is not intended to be exhaustive or to limit the invention to the precise form disclosed. It is chosen and described to illustrate the principles of the invention and its application and practical use to enable others skilled in the art to utilize its teachings.

Referring now to the drawings, reference numeral 10 refers generally to the leveler of this invention. Leveler 10 includes a base frame 12, a lower subframe 14, and an upper subframe 16. Lower subframe 14 is supported above base frame 12 by a plurality of lifting devices, illustrated as screw jacks 18. Upper subframe 16 is pivotally connected to base frame 12 through pivot pins 20 which extend through ears 13 of the base frame as shown. One or more lifting devices, illustrated as hydraulic sylinders 22 are connected between base frame 12 and upper subframe 16 as shown. Cylinders 22 and jacks 18 may be connected to an encoding device 23 which ensures accurate positioning of the subframes 14 and 16 in the various working positions shown in FIGS. 1-3. Screw jacks 18 may be mechanically connected to allow for simultaneous operation. The manner of connection illustrated includes gears 50, shafts 52, sprockets 54 and chains 56 but may take on any construction acceptable in the art.

Figure 5:
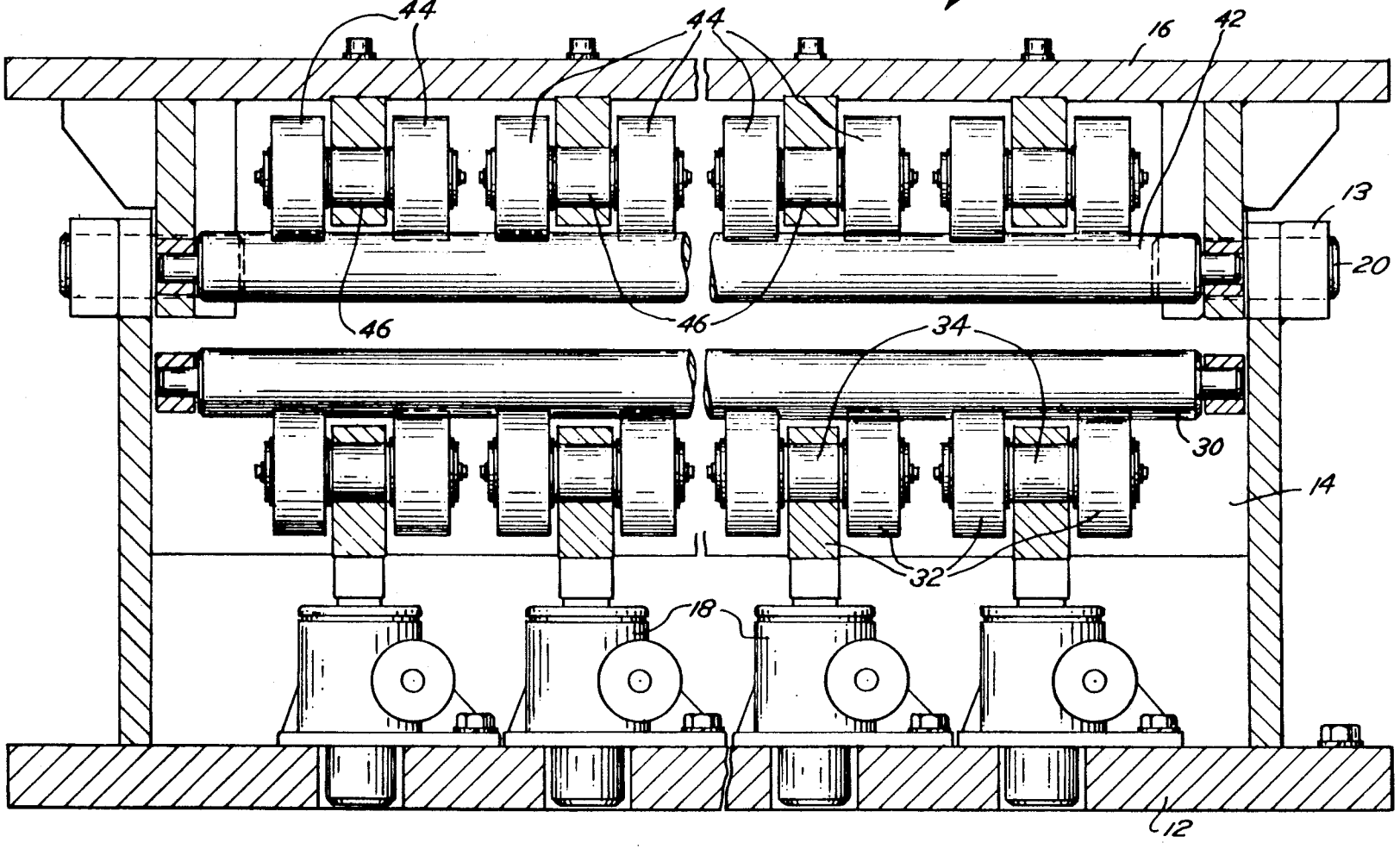
FIG. 5 is a sectional view taken along line 5—5 of FIG. 1.

Lower subframe 14 carries a plurality of work rollers 24, 26, 28, 30 journalled in the lower subframe as shown in the drawings. Each reference numeral 24–30 refers to a pair of rollers with each pair of rollers of a different size to accommodate varying gauges of slit steel 8. Subframe 14 also houses a plurality of backup rollers 32 which are journalled in bearings 34 connected to subframe 14 as shown in FIG. 5. Backup rollers 32 serve to provide support for work rollers 24–30 during leveling operations.

Likewise, upper subframe 16 carries a plurality of work rollers 36, 38, 40, 42 which are journalled in the upper subframe as shown. Each numeral 36–42 refers to a pair of work rollers which are alignable with a respective work roller 24–30 in lower subframe 14 as shown. Subframe 16 also houses a plurality of backup rollers 44 journalled in bearings 46 connected to subframe 16. As with backup rollers 32, backup rollers 44 provide support for work rollers 36–42 during leveling.

Leveler 10 generally operates in a steel slitting line (not shown) and is positioned between a slitter (not shown) and a recoiler (not shown) and serves to remove bends, burrs and other flaws in the slit steel 8. FIG. 1 illustrates the leveler 10 in a first work position with rollers 24 and 36 in the work position. As illustrated, rollers 36, 38, 40 are angled upwardly relative to roller 24 and rollers 26, 28, 30 are on the same plane as roller 24. This positioning allows steel 8 to be pulled over rollers 38–42 and between rollers 24, 36 which contact and compress the steel to remove imperfections in the surface prior to the steel reaching the recoiler (not shown). The leveler illustrated is commonly referred to as a pull through leveler which relies on the pulling force of the recoiler to pull the steel through the leveler 10 and between work rollers 24, 36.

Figure 2:
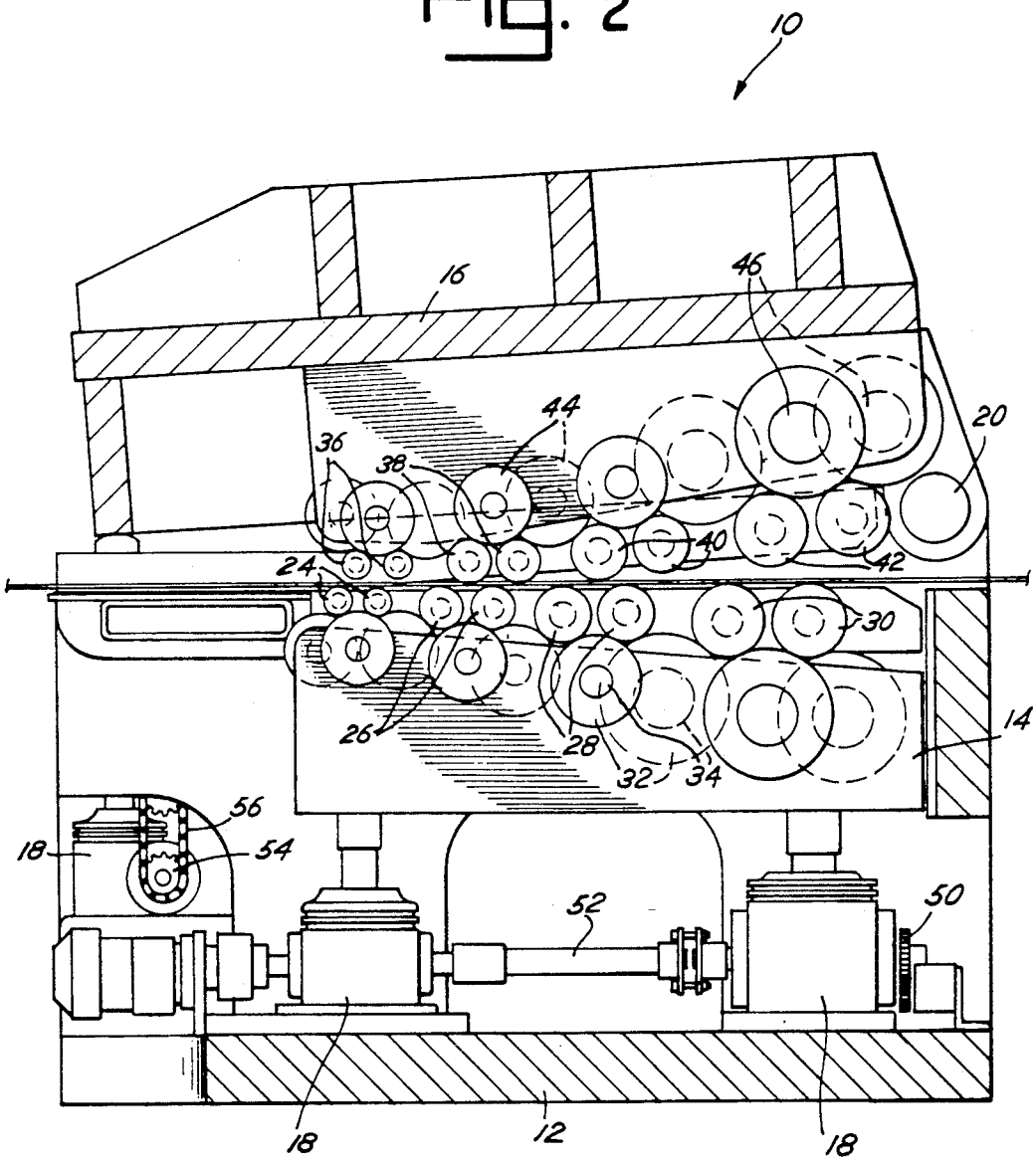
FIG. 2 is a view similar to FIG. 1 with the leveler in a second working position.

FIG. 2 illustrates the leveler 10 in a second working position used when leveling heavier gauge steel . This position is achieved by actuating cylinders 22 to pivot upper subframe 16 upwardly until rollers 26 are aligned with the pass line for seel strip 8. Screw jacks 18 are then actuated to raise lower subframe 14 to the proper height, which will depend on the gauge of steel 8 to be levelled. In this position, work rollers 26 and 38 perform the actual leveling of the steel.

Figure 3:
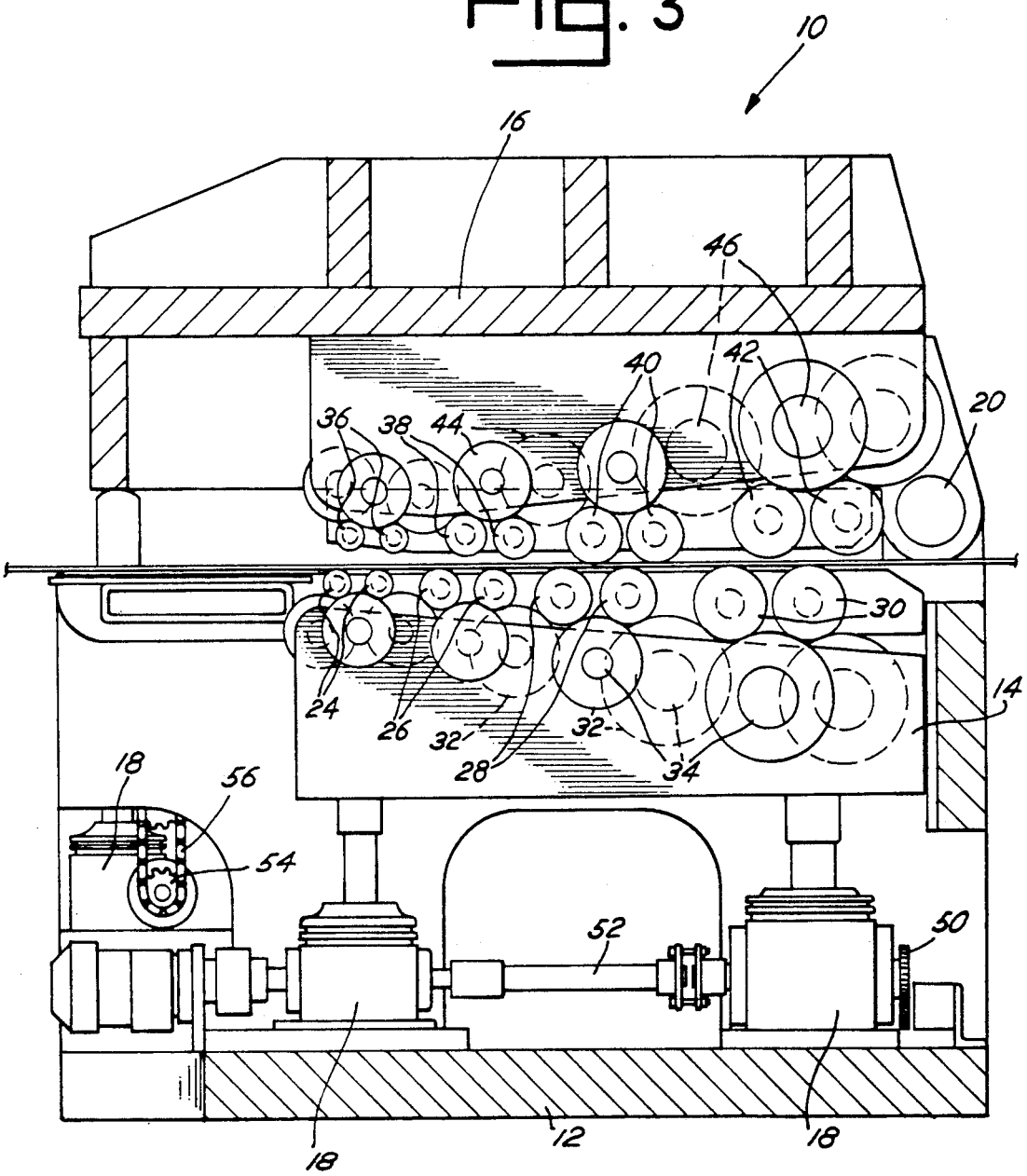
FIG. 3 is a view similar to FIG. 1 in a third working position.
Figure 4:
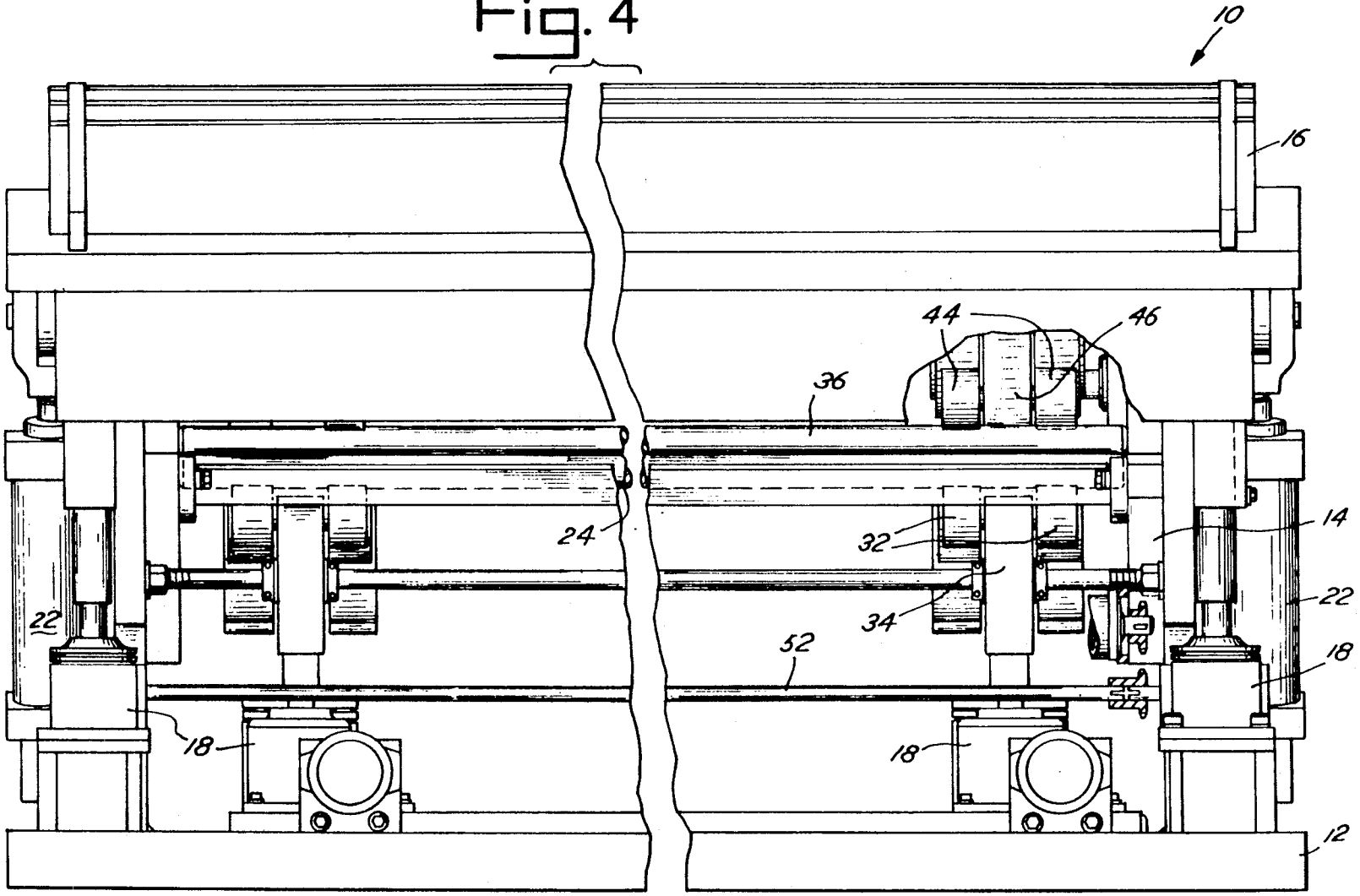
FIG. 4 is an end view of the leveler.

Likewise, FIG. 3 illustrates the leveler 10 in a third position in which subframes 14, 16 have been adjusted as above described to align work rollers 28, 40. Further adjustments as above described will align rollers 30, 42 to allow levelling of heavier gauge steel.

It should be noted that leveler 10 may be constructed with any number of back up rollers in a 4 high or 6 high configuration dependent upon the type of slitting line the leveler will be used in without departing from the spirit of the invention. The scope of this invention is limited only by the language of the following claims.

We claim:

1. A machine for leveling different gauge slit steel fed along a generally horizontal path prior to recoiling, said machine comprising a main frame, a first subframe housing a plurality of first rotatable leveling rollers engageable with said slit steel of varying sizes slidably connected to said main frame, a second subframe housing a plurality of second rotatable leveling rollers engageable with said slit steel of varying sizes pivotally connected to said main frame, the varying sizes of said leveling rollers in said first subframe being of substantially the same size to the varying sizes of said leveling rollers in said second subframe, means for effecting pivoting movement of said second subframe relative to said first subframe about only one axis wherein one of said plurality of second leveling rollers is aligned vertically with one of said plurality of first leveling rollers of substantially the same size, and means for effecting sliding movement of said first subframe to adjust spacing between said one first and second leveling rollers so as to place the substantially same sized leveling rollers of said first subframe and siad second subframe in operative relationship with one another to accommodate one specific gauge of steel passing therebetween selected from the different gauges of steel.

2. The machine of claim 1 wherein said means for effecting pivoting movement includes a hydraulic cylinder connected between said second subframe and said main frame.

3. The machine of claim 2 and encoder means operatively associated with said hydraulic cylinder for precisely regulating pivoting movement of the second subframe.

4. The machine of claim 2 wherein said means for effecting sliding movement includes a screw jack connected to said first subframe and said main frame.

5. The machine of claim 1 and a plurality of rotatable backup rollers housed in each first and second subframe in association with said first and second leveling rollers.

* * * * *